US008770533B2

(12) United States Patent
Hand et al.

(10) Patent No.: US 8,770,533 B2
(45) Date of Patent: Jul. 8, 2014

(54) ADJUSTABLE, RETRACTABLE CEILING AND WALL HANGING SYSTEM

(76) Inventors: James Arthur Hand, Lee's Summit, MO (US); Sheryl Elaine Hand, Lee's Summit, MO (US)

( * ) Notice: Subject to any disclaimer, the term of this patent is extended or adjusted under 35 U.S.C. 154(b) by 861 days.

(21) Appl. No.: 12/592,412

(22) Filed: Nov. 24, 2009

(65) Prior Publication Data

US 2010/0148028 A1 Jun. 17, 2010

Related U.S. Application Data

(60) Provisional application No. 61/201,631, filed on Dec. 15, 2008.

(51) Int. Cl.
*A47H 1/10* (2006.01)

(52) U.S. Cl.
USPC ..... 248/329; 248/317; 248/309.1; 242/379.2

(58) Field of Classification Search
USPC ..... 248/330.1, 302, 303, 304, 309.1, 317, 248/322, 327, 329, 339; 242/379.2, 380; 224/162
See application file for complete search history.

(56) References Cited

U.S. PATENT DOCUMENTS

| | | | | |
|---|---|---|---|---|
| 4,112,550 | A | 9/1978 | DeWitt et al. | |
| 4,135,692 | A | 1/1979 | Ferguson | |
| 4,556,184 | A | 12/1985 | O'Sullivan | |
| 5,052,733 | A | 10/1991 | Cheung et al. | |
| D321,639 | S | 11/1991 | Adams | |
| 5,247,725 | A | 9/1993 | Vaughn, Jr. | |
| 5,490,651 | A | 2/1996 | Kump | |
| 5,553,905 | A | 9/1996 | Bentivegna | |
| 5,580,021 | A * | 12/1996 | Gillanders | 248/330.1 |
| 5,632,519 | A | 5/1997 | Stock | |
| 5,833,165 | A | 11/1998 | Paugh | |
| 5,870,845 | A | 2/1999 | Ruderman et al. | |
| 5,954,288 | A * | 9/1999 | Shih | 242/380 |
| 6,036,153 | A | 3/2000 | Rose et al. | |
| 6,073,875 | A | 6/2000 | Paugh | |
| 6,293,601 | B1 | 9/2001 | Johnson | |
| 6,634,610 | B1 * | 10/2003 | Ricci et al. | 248/330.1 |
| D497,086 | S | 10/2004 | Lopes | |
| 6,976,662 | B2 | 12/2005 | Kump et al. | |
| D580,747 | S | 11/2008 | Pollak et al. | |
| 7,464,893 | B2 * | 12/2008 | Spjut | 242/385.4 |
| 8,191,815 | B2 * | 6/2012 | Huang | 242/379 |
| 8,446,279 | B2 * | 5/2013 | Jennings, III | 340/568.1 |
| 2010/0148028 | A1 * | 6/2010 | Hand et al. | 248/330.1 |
| 2010/0206976 | A1 * | 8/2010 | Salentine et al. | 242/379.2 |
| 2010/0243783 | A1 * | 9/2010 | Hermann, II | 242/377 |

* cited by examiner

*Primary Examiner* — Todd M Epps
(74) *Attorney, Agent, or Firm* — Mashburn Law Office; Donna Denise Mashburn

(57) ABSTRACT

An, adjustable, retractable hanging system that enables hangers to be easily attached, moved, and removed from a ceiling or wall rail. The hanger, which houses a spring-loaded reel and a retractable cable, is backed with a pressure-clip or in an alternate embodiment, a raised platform. The hanger affixes to a ceiling or wall rail by means of a pole and cup assembly. Once attached to a ceiling or wall, the retractable cable within the hanger extends to receive the object to be hung. The cable is reached by means of a hook that is affixed to the pole and cup assembly and is lowered to within arm's reach. An adjustable cable-stop, which is also attached to the cable, allows individuals the ability to adjust the suspending height of the object to be hung.

10 Claims, 6 Drawing Sheets

ADJUSTABLE, RETRACTABLE CEILING AND WALL HANGING SYSTEM

CROSS-REFERENCE TO RELATED APPLICATIONS

This application claims priority to the U.S. Provisional Patent Application Ser. No. 61/201,631, filed Dec. 15, 2008, which is incorporated herein.

BACKGROUND OF THE INVENTION

The invention relates to hanging devices and ceiling clips for suspended ceilings, with specific application, but not limitation, to classroom use. Pertinent prior ceiling clips or hanging systems related to the invention can be found in US patent Class 248, subclasses 317, 323, 328, 329, and 330.1; additionally, US patent Class 40, subclass 601 and 617.

Many buildings around the world are fitted with suspended ceilings, which are constructed of inverted "T-shaped" members that cross one another creating a rectangular grid on which lighting, venting, and ceiling panels are positioned. This invention's adjustable, retractable hanging system was conceived for use within such ceilings, although its utility is not limited to same.

This invention was created to address specific needs of teachers. Presently, teachers or other individuals who wish to hang student work or embellish a classroom's ceiling with decoration must use hanging devices that require ladders. Given the difficulty accessing and utilizing ladders in a school environment, teachers often stand on desks to reach ceiling bars or high points on walls, an action too often resulting in injury to teachers or students. Risk managers of school districts report that "non-ladder" falls, specifically related to teachers standing on desks, remain a significant source of injury to teachers. While this invention, at its inception, was geared to the classroom environment, it has utility in numerous applications outside the classroom.

Existing hangers that are intended for lightweight use do not offer mounting apparatuses that preclude ladder use, do not allow for easy movement or removal of the hanger, do not offer ease in reaching the mounted hanger, and offer no flexibility in changing the height of the item to be hung. While some heavyweight hangers have been patented that allow access from standing height, they are generally devised to suspend weighty signage in commercial settings. As such, they are massive, heavy, expensive, difficult to move, and cannot be affixed to the ceiling without the use of a ladder. Moreover, no patented or commercial hanging apparatuses address the dual problems of making both ceilings and high walls accessible for the teacher or other individuals without the use of a ladder.

Ceiling hangers of many types are currently marketed, but none offer a dynamic system that presents both ease of installation without the use of ladders, flexibility of placement and removal, retractable linkage, and applicability to both ceiling and wall. To illustrate, U.S. Pat. No. 4,112,550 employs a partially flexible ceiling bar attachment mechanism intended for suspended ceilings, from which extends a hook. Opposing flanges grip the sides of the "T-bar" to position it in place. U.S. Pat. D321,639 offers a clipping mechanism, also intended for suspended ceilings, that uses sliding opposing flanges for clasping the edges of a ceiling rail. Likewise, U.S. Pat. No. 6,036,153 presents a clipping mechanism intended for use in suspended ceilings whose design allows for multiple linkages in a chaining fashion from the original point of attachment. Each of the above cited hangers is deficient since each requires ladders for installation, lacks ease of ceiling attachment or removal, lacks ease in attaching materials to be suspended, lacks ease in adjustability in suspension height of the material to be hung, and lacks utility in wall applications.

Other prior art, while offering a system to assist in hanging items without ladder assistance, does not offer either the simplicity of operation, the retractable cabling, or the adjustability in suspension depth required for low-ceilinged interior application. For example, U.S. Pat. Nos. 5,490,651; 6,976,662 B2, and D580,747, each an improvement upon previously cited art, offer ceiling hook systems which allow for snap-fitted or interlocking ceiling clips that grasp the ceiling bars, and which also employ poles that pressure fit the ceiling hooks to the suspended ceiling members. These hooking apparatuses are deficient, however, in that the hooks are fixed to the ceiling, and thereby do not allow the user to attach items or reposition items without the use of a ladder. Moreover, both hangers and poles are deficient in that they cannot be used for wall applications.

U.S. Pat. No. 5,870,845 offers a retractable device housed within a crossbar configuration that allows a user to raise or lower signage from a floor standing position, thereby allowing flexibility in height adjustment. Additionally, U.S. Pat. No. 6,634,610 offers a bar-type hanging device with a take-up reel. However, these inventions, due to their mass, are clearly intended for heavy industrial or commercial use since they require ceiling heights well in excess of the typical 8-9 feet within a classroom. Furthermore, the complicated structure of these systems would be cost-prohibitive for classroom applications. Moreover, while these inventions employ a tool for raising or lowering the signage, they do not offer a tool for mounting and removing the original hanger from the ceiling. Thus, ladders must be used in their application. Additionally, these devices have no adaptability to wall use.

Of possible relevance, prior art involving simple take-up reels exists, two of which are seen in U.S. Pat. Nos. 5,833,165 and 6,073,875. Though these patents employ retracting reels, given that these reels were intended for use at pocket height for badge or key application, the reels are deficient in that they do not have the stop-mechanism employed in the preferred embodiment, do not readily attach to suspended ceilings, do not offer either the ceiling clip used in this system or the cup and pole assembly. Consequently, they are not effective for use on ceilings or walls.

U.S. Pat. No. 4,556,184, a device intended for plant hanging, offers a take-up reel construction with latching similar to that used on window shades. This art, intended to suspend heavy weights, relies on a winding take-up reel and locking mechanism that would not be practical in classroom applications. Also, this device cannot be affixed to a ceiling without the use of a ladder, is not adaptable to wall applications, and does not offer mobility of placement.

The superiority of this invention is enhanced by the ease by which the hanger can be attached, moved, and removed from the walls or ceilings on which the hanger is used without the use of a ladder.

Prior art offers poles that are associated with hanging devices, that raise and lower the hanging apparatus, but which fall short of the design utility of the cup and pole assembly within this system U.S. Pat. Nos. 5,490,651; 6,976,662 B2; and D580,747 are examples of such. These pole assemblies just assist in mounting the hanger. Similarly, U.S. Pat. No. 5,247,725, is applies a scissor-type action on a pole assembly to compress clips for applications to ceilings, but cannot assist in bringing hangers within reach. U.S. Pat. Nos. 5,870,845 and 6,634,610 assist in drawing the hangers within easy reach, but do not assist in mounting or removing the hangers from the ceiling. Clearly, while some pole assemblies may be used to apply or remove the hangers and some will assist in bringing the hanger within arm's reach, none can do all of the above, and none are adaptable to wall applications.

Of possible interest is other prior art related to just poles. U.S. Pat. No. 5,632,519 reveals a levered pole for hanging objects. U.S. Pat. No. 6,293,601 utilizes a telescoping pole with a simple hook assembly. Other poles of possible relevance can be found in U.S. Pat. D497,086; U.S. Pat. Nos. 5,553,905; 5,052,733 and 4,135,692. These pole assemblies are deficient in that they do not (a) lower the hooking apparatus to within typical standing reach, (b) easily move the hanger to new locations, (c) easily provide for the hanger's removal, and (d) do not offer adaptations to attach the hanger to both the ceiling and wall.

Of additional interest to the inventors was the development of a cable stopping mechanism that would allow the user of the hanging system the ability to adjust the hanging height simply and efficiently. Previously mentioned reels in U.S. Pat. Nos. 5,833,165 and 6,073,875 offer no adjustable stopping mechanism. In these applications, the cable stops only when fully retracted. Prior art found in U.S. Pat. No. 5,870,845 utilizes a motorized system to halt the cable, a system both too expensive and impractical for lightweight use. U.S. Pat. No. 6,634,610 offer a cable stopping mechanism that encases the cable and is tightened or opened with a thumbscrew. None of the prior art offers the simplicity of action as that offered by the cable-stop in the embodiments of the invention.

OBJECTS AND ADVANTAGES

It is the primary object of the present invention to provide an improved hanging system that will prevent injury to users intent upon hanging items from ceilings or high walls by being completely functional while the user remains on terra firma.

Another object concerns a system with the ability to extend and retract the hanging cable, enabling the user to bring attaching mechanisms within arm's reach. This is accomplished by use of a spring-loaded reel, a cable attached to the reel, and devices attached to the cable.

Another advantage is the ability to adjust the hanging height of the object, accomplished by use of a specialized cable-stop attached to the cable that retracts onto the reel. For simplicity, the cable-stop herein is described as a ring, but it may be replaced by any one of numerous equivalent alternatives.

Another object of the invention is to create a system with portability with regard to the hangers, so they can be easily applied to the ceiling or wall, moved or removed. This is accomplished with the pressure-clip or in the alternative embodiment, a raised platform on the hanger's back and use of a pole and attachments.

Another object of the invention is to create a system that will allow the user ability to secure the retractable hanger to ceiling or wall while remaining on ground, assisted by a pole topped by a specialized cup, hereafter referred to as a cup.

Another advantage of the embodiments of the invention is to provide a system with the capability to pull the retractable cable to within arm's reach, facilitated by a hook on the cup and pole assembly.

Still another advantage of the embodiments of the invention is to provide a system that makes high walls easily accessible without ladders, facilitated by a wall rail to which the retractable hanger can be affixed.

Yet another object of the invention is to provide a system that offers an adjustable arm assembly that adjusts to various angles, to meet a comfortable degree of approach, to mount the retractable hanger on the wall.

Another object of the invention is to provide a hanging system that allows the user the ability to accomplish a hanging task easily, quickly, and safely.

A final object of the invention is to create simplicity of operation and system, thereby reducing complications and costs to users, accomplished by all of the component parts.

BRIEF SUMMARY OF THE INVENTION

The various embodiments of the invention engages the use of a hanger, which contains a reel and retractable cable withdrawn by a constant pull steel spring; a retractable hanger, referred hereafter as a hanger, offers optional backings adapted to individual ceiling types; a cup that assists in affixing and removing the hanger; a pole and cup assembly with an affixed hook; an adjustable arm; and a wall rail.

In the first embodiment, the hanger is fitted with a pressure-clip to attach the hanger to the suspended ceiling. Within the hanger is found retractable wheel in tension with spring steel, and an internal cable. On the exterior of the hanger, wound by the cable is found a cable-stop, which will allow for variety in hanging distances as related to the ceiling, and a clipping mechanism for attaching materials (referred to herein as a clip).

In this first embodiment, the pressure-clip is constructed to exert constant, flexible pressure on the inverted T-bar member once affixed. The clip is parallel to the back of the hanger, and when affixed to the inverted T-bar (hereafter referred to as a T-bar) positions the hanger parallel to the ceiling.

The cable is threaded through a cable-stop, illustrated here as a ring, and is bound by a looping pattern. The cable-stop is easily moved along the cable by exerting pressure upon it. When the cable-stop is engaged, it gives sufficient pressure to the cable to stop it from being fully withdrawn into the hanger. This feature allows the user to determine the distance at which the item to be hung will suspend from the ceiling. The placement of the cable-stop in relation to the hanger offers an added advantage, as it is secured directly above the clip. Since the features of this invention allow the clip to be drawn within easy arm's reach, the cable-stop is also easily engaged and easily adjusted to meet the needs of the user.

The hanger, equipped with the cable-stop and clipping mechanism, is attached to the T-bar through the use of a cup. The side of the cup is notched, and the hanger is positioned inside of the cup with the cable-stop and clip to located outside the walls of the cup.

The cup is affixed to a pole. The user simply extends the cup to the ceiling, applies pressure from beneath the ceiling panel to slightly lift it, slides the hanger's pressure-clip onto the T-bar member, and withdraws the cup.

In an alternative embodiment adaptations are made for ceilings dissimilar to the one previously described. Some suspended ceilings have T-bars that are recessed from the plane of the ceiling panels. In these suspended ceilings the acoustical panels extend below the T-bar, making the pressure-clip unworkable. For these suspended ceilings, an alternative back for the hanger is designed. Rather than being fitted with a pressure clip, the backs of hangers for this application are designed with a raised platform that will facilitate the attachment of an adhesive, magnet, or another equivalent alternative.

The pole assembly has further utility. Having attached the hanger to the ceiling, the pole and cup assembly are withdrawn. The pole and cup assembly is fitted with a simple open hook. The teacher/user can tip the hook to grasp the clip on the cable, draw it within arm's reach. After an object is attached to the clip, the hook is used to grasp either the clip or the cable-stop and raise the suspended object to the desired height.

An additional part of this hanging system is the wall rail. Installed near the ceiling line on the walls of the classroom or other facility, it now ensures complete safety in hanging items about the room. This rail consists of a single construction that bends in two places to allow room for mounting the pressure-clip backed hanger in a vertical position. The back of the rail is mounted flush to the wall and secured to the wall by screws or adhesive. A narrow trough is formed at the base of the rail as it bends away from the wall at a 90-degree angle, creating a void required to clear the pressure clip. Then again, the rail bends upward at another 90-degree angle, creating a lip onto which the hanger can be affixed. With both ceiling and walls now accessible to individuals without standing on a ladder or desk, the user of the adjustable, retractable ceiling and wall hanging system is guaranteed safety from falls.

To meet the needs of wall applications, an adjustable arm allows the user to adjust the angle of the cup to meet different angles of application. To facilitate attachment of the hanger to the wall rail, this pole attachment has an interlocking mechanism that allows the user to change the angle of the cup in relationship to the pole, which will allow the user to better meet the vertical plane of the wall. Various designs and construction materials exist for such adjustable arms, and no claim is made to any specified design or construction material.

As important to the invention as its ease of attachment to the ceiling or wall is the ease by which it is moved or removed. A simple reversal of the hanging action removes the hanger from wall or ceiling, allowing the user flexibility in use, again, notably, without ever having to leave the safety of a floor position.

The various embodiments illustrates a hanging assemblage designed to prevent ladder and non-ladder falls by providing articulated parts that together create a system by which items can be easily, inexpensively, safely, and securely mounted to both ceiling and wall.

BRIEF DESCRIPTION OF THE SEVERAL VIEWS OF THE DRAWINGS

Referring now to the drawings in which like reference numbers represent corresponding parts throughout.

DETAILED DESCRIPTION OF THE INVENTION

An adjustable retractable hanging system that permits attaching, removing, and repositioning suspended objects from a ceiling or wall rail without using a ladder or any other elevating device. Other embodiments may be utilized and structural changes may be made without departing from the scope of the present invention. Every element may be replaced by any one of numerous equivalent alternatives, only some of which are disclosed in the specification.

Figure 1:
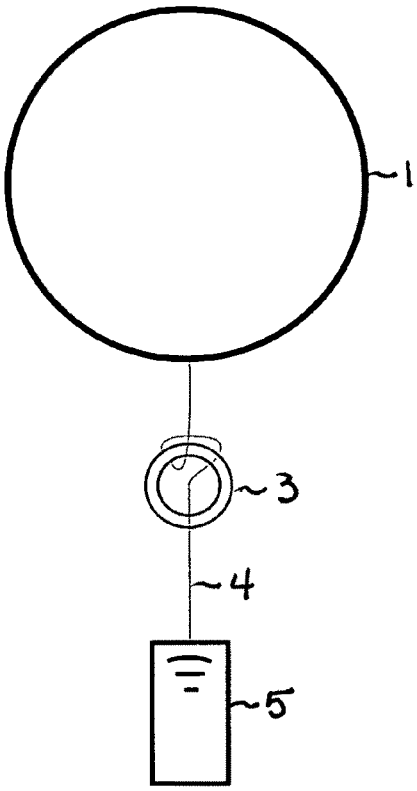
FIG. 1 is a schematic of the hanger on a vertical plane, with the cable slightly extended to reveal the cable-stop. The retractable cable and spring-loaded reel is understood to be within the hanger. A clip, seen here with a front view, is attached to the end of the cable.

Turning to FIG. 1, there is illustrated a hanger 1, shown here on a vertical plane, in which is housed the spring-loaded reel for the cable 4. In this illustration the cable 4 is partially extended to reveal the moveable cable-stop 3. The cable has been uniquely looped around the cable-stop 3, illustrated here as a ring, adding tension to the cable. This looping causes sufficient friction between the cable-stop and the cable so as to assist in halting the retracting action of the retractable reel. The cable-stop 3 can be easily manipulated to move to any spot along the cable where the user wishes to halt the action of the retractable reel within the hanger 1. Also visible from this view is the clip 5, which is affixed to the end of the cable 4.

Figure 2:
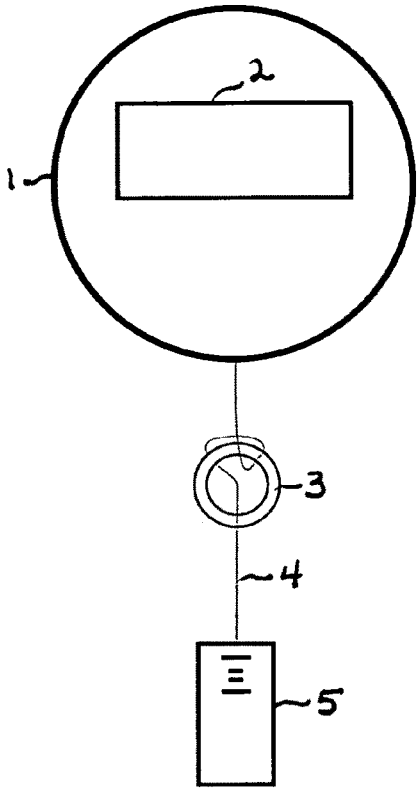
FIG. 2 illustrates the hanger reversed from FIG. 1, to reveal the pressure-clip.

Moving to FIG. 2, there is presented a reverse illustration of FIG. 1, whereby the pressure-clip 2 on the back of the hanger 1 is revealed.

Depending upon manufacturing constraints, this pressure-clip 2 will be either molded as part of the back of the hanger 1 housing or will be affixed to the hanger 1 assembly. The pressure-clip 2 is engineered to snugly fit the T-bar 6 and wall rail 7, so as to safely secure it in place.

Figure 3:
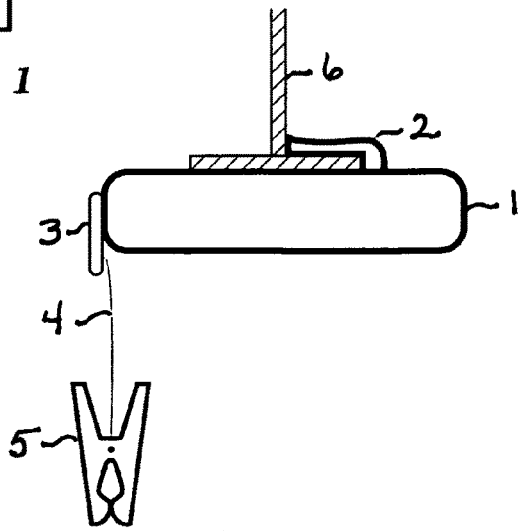
FIG. 3 illustrates a side view of the hanger, now on a horizontal plane and mounted to the T-bar of a suspended ceiling member. The pressure-clip is visibly attached to the T-bar.

Examining FIG. 3, the hanger 1, now on a horizontal plane, can be seen attached to the T-bar 6; the side view of the pressure-clip is clearly visible. The pressure-clip 2 on the back of the hanger 1 fits securely on the T-bar 6, withstanding the pressure that will be placed upon it when the cable 4 is extended or retracted. In this view, the cable-stop 3 has halted the retractable reel within the hanger 1, and the cable 4 extends some distance from the T-bar 6.

Figure 4:
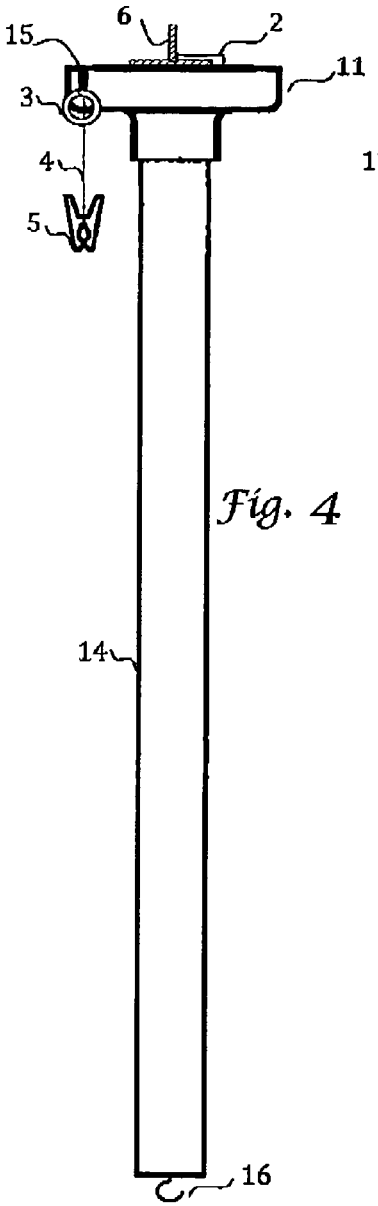
FIG. 4 illustrates the hanger still within the cup after it has been attached to the T-bar. Also visible are the cup and pole assembly with the hook affixed to end of a rigid installation pole.

FIG. 4 illustrates the pole 14 and cup 11 assembly. The cup 11 is attached to the upper end of the pole 14, and the open hook 16 is affixed to the base of the pole 14. In this view the hanger 1 is still within the cup 11, and the cup is in position to assist in attaching the hanger 1 to the T-bar 6. When employing the pole 14 assembly, the user simply lifts the cup 11 containing the hanger 1 to the suspended ceiling, slides the hanger's 1 pressure-clip 2 onto the T-bar, and removes the cup 11 and pole 14 assembly. The pole 14 is then rotated on end, and the hook 16 is used to grasp the clip 5 and extend it to within reach so an object can be attached to the clip 5. Also revealed in FIG. 4 is the cable slot 15 in the cup 11, which allows the cable 4, cable-stop 3, and clip 5 to be placed outside the cup 11 while installing the hanger 1 to the T-bar or wall rail.

Figure 5:
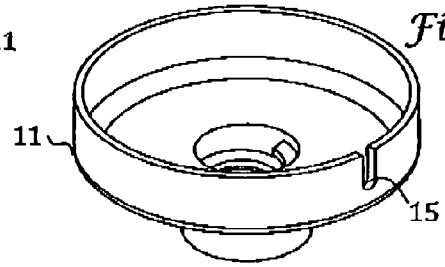
FIG. 5 reveals the interior of the cup and notched side.

FIG. 5 reveals the interior and exterior of the cup 11, showing a clearer view of the cable slot 15.

Figure 6:
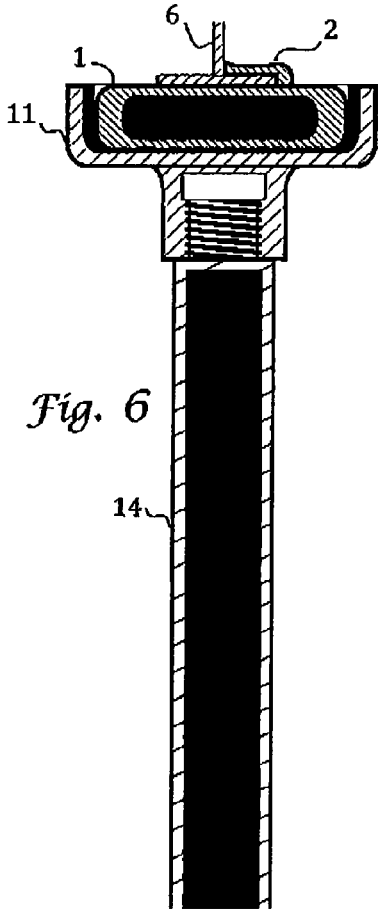
FIG. 6 illustrates a cutaway view of the hanger within the cup and attached to the T-bar.

FIG. 6 reveals a cutaway view of FIG. 4, revealing the hanger 1 within the cup 11. Also visible is the connection between cup and pole. While the connection illustrated here reveals a threaded coupling, it is conceivable that other connections could be configured without departure from the present invention.

Figure 7:
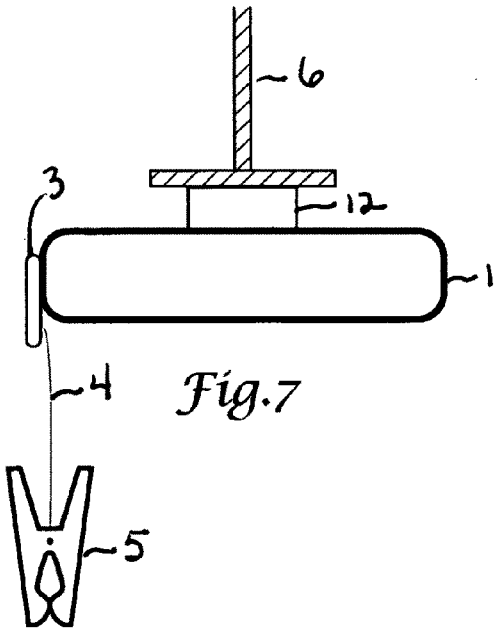
FIG. 7 illustrates a horizontal view of the hanger's alternative embodiment with a raised rectangular platform where a magnet or adhesive can be attached to the platform surface to aid in attaching the hanger to the T-bar.

FIG. 7 illustrates a horizontal view of hanger 1, now attached to the face of the T-bar 6. The rectangular base 12, now covered with either a magnet, adhesive, or another equivalent alternative, attaches hanger 1 to T-bar 6. In this alternative embodiment, the rectangular base 12 that protrudes from the back of the hanger 1, is precisely engineered to allow the hanger applicability to ceilings with acoustical panels that extend beyond and below the T-bar cross members.

Figure 8:
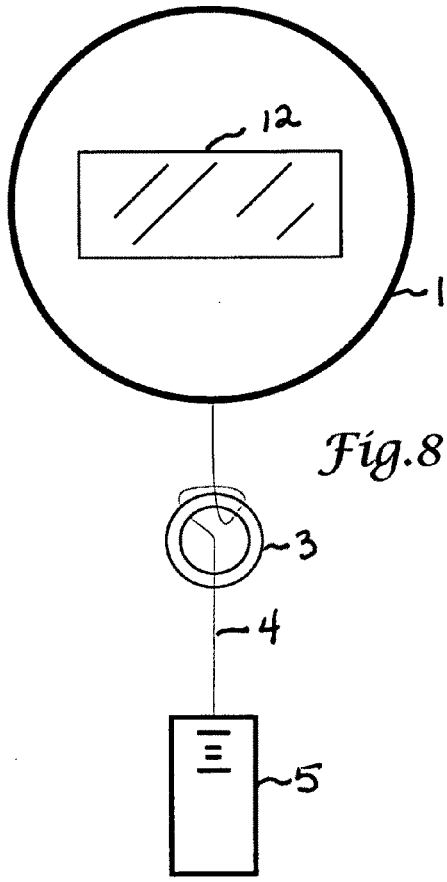
FIG. 8 is a vertical view of the alternative embodiment

FIG. 8 illustrates the hanger 1, now on a vertical plane, with the rectangular base 12 fitted with a magnetic, adhesive material, or another equivalent alternative.

Figure 9:
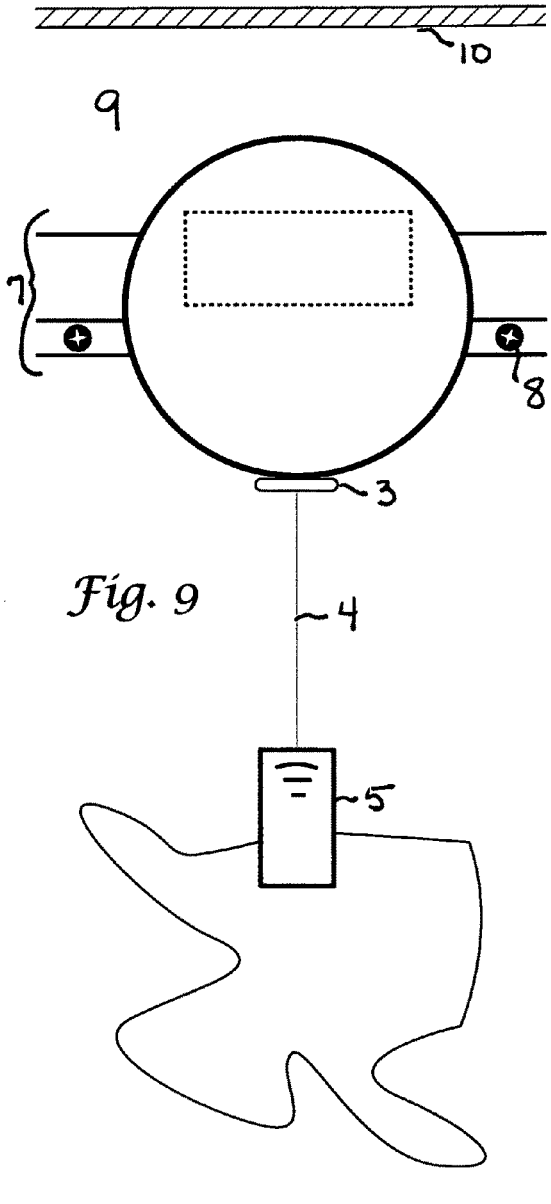
FIG. 9 reveals the alternative embodiment now attached vertically to the wall rail, which is mounted on a wall.

FIG. 9 shows the hanger 1, on a vertical plane, now fitted with the pressure-clip 2 of the first embodiment, affixed to the wall rail 7. The wall rail 7 is mounted on the wall 9 near the ceiling 10. Here the cable-stop 3 has halted the retractable cable 4 some distance from the clip 5. The clip 5 within this illustration is shown holding an item. Here also, the mounting screws 8 can be clearly seen as they are in place to secure the wall rail 7 to the wall 9. However, the wall rail is designed to adapt to installations where it would be preferable to mount it with adhesive or tape.

Figure 10:
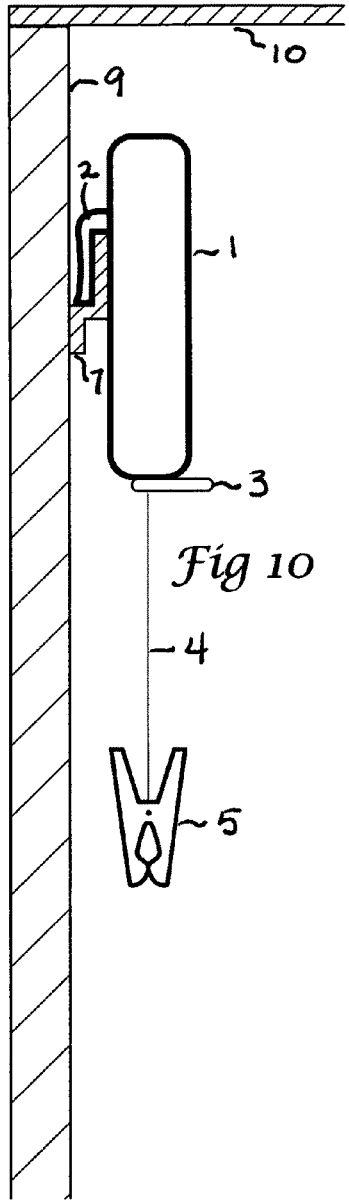
FIG. 10 reveals a side view of the hanger that has been installed on the wall rail. The wall rail, attached to the wall, bends away creating a void in which the pressure-clip can rest. The pressure-clip fits on the upper extension of the wall rail just as it fits on the T-bar.

FIG. 10 reveals a cutaway wall and side-view of the hanger 1 as it is mounted to the wall rail 7, which is affixed to a wall 9. As seen in FIG. 9. The cable 4 is slightly extended and the retracting action within the hanger 1 is stopped by the cable-stop 3. The wall rail 7 extends sufficiently away from wall 9 and ceiling 10 to allow it to receive the pressure-clip 2 and secure the hanger 1.

Figure 11:
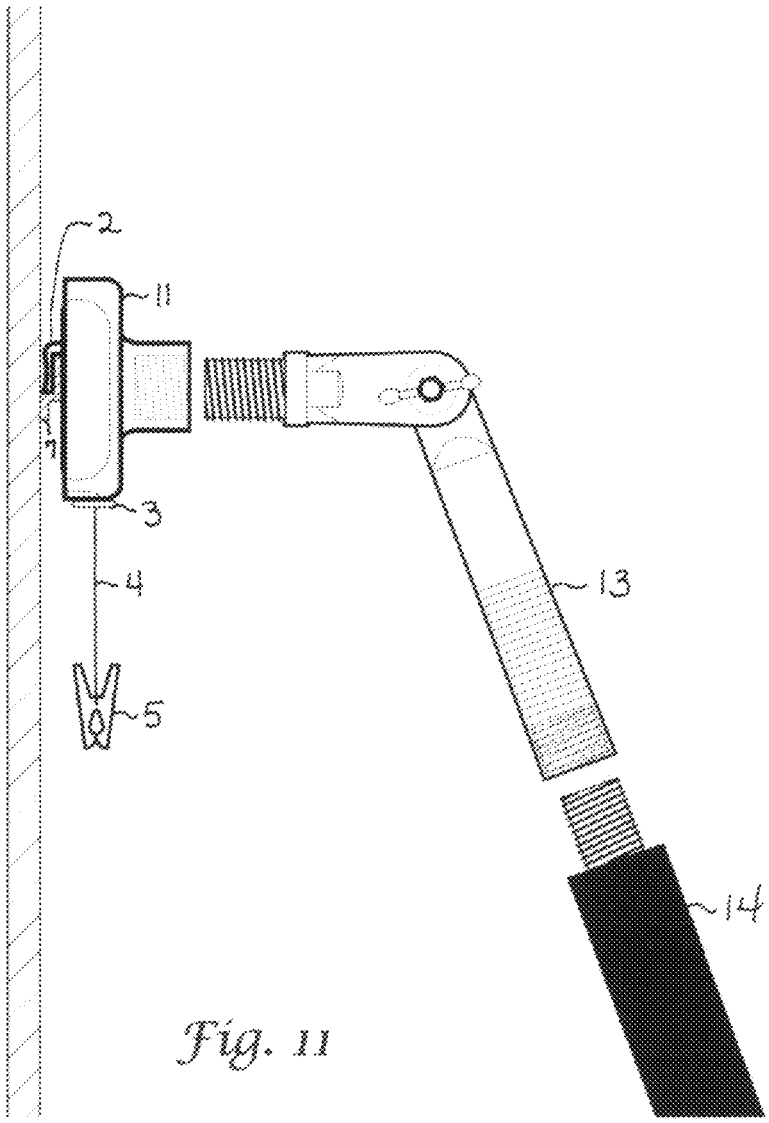
FIG. 11 illustrates the entire system engaged to place the hanger on the wall rail. The hanger remains in the cup. Supporting the cup is an embodiment of the adjustable arm. The adjustable arm is positioned at the top of the pole beneath the cup, and is bent to accommodate a comfortable position for mounting the hanger to the wall. The adjustable arm allows an angular adjustment to be made up to 90 degrees from that viewed in FIG. 4.

FIG. 11 shows the cup 11 attaching the hanger 1 to the wall rail 7, which is affixed to a wall 9. The adjustable arm 13 beneath the cup has been angled to comfortably mount the hanger 1 to the wall rail 7. Here again the linkage is shown to be completed with a threaded coupling, but other connections could be configured without departure from the present invention.

It is thought that the present invention will be understood from the foregoing description and it will be apparent that various changes may be made without departing from its spirit and scope or sacrificing all of its material advantages, the form herein before described being merely preferred or exemplary embodiment thereof.

Figure 12:
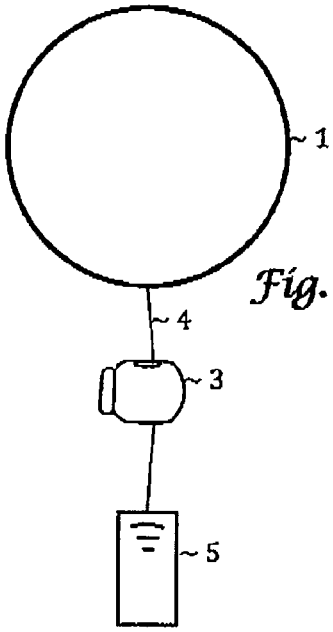
FIG. 12 is a schematic of the hanger on a vertical plane, with the cable slightly extended to reveal another embodiment of the cable-stop. The retractable reel is understood to be within the hanger. A clip, seen here with a front view, is attached to the end of the cable.

Turning to FIG. 12, there is illustrated a hanger 1, shown here on a vertical plane, in which is housed the spring-loaded reel for the cable 4. In this illustration the cable 4 is partially extended to reveal, another embodiment of the moveable cable-stop 3. The cable 4 passes through the cable-stop 3 to causing sufficient friction between the cable-stop 3 and the cable 4 so as to assist in halting the retracting action of the retractable reel. The cable-stop 3 can be easily manipulated to move to any spot along the cable where the user wishes to halt the action of the retractable reel within the hanger 1. Also visible from this view is the clip 5, which is affixed to the end of the cable 4.

Figure 13:
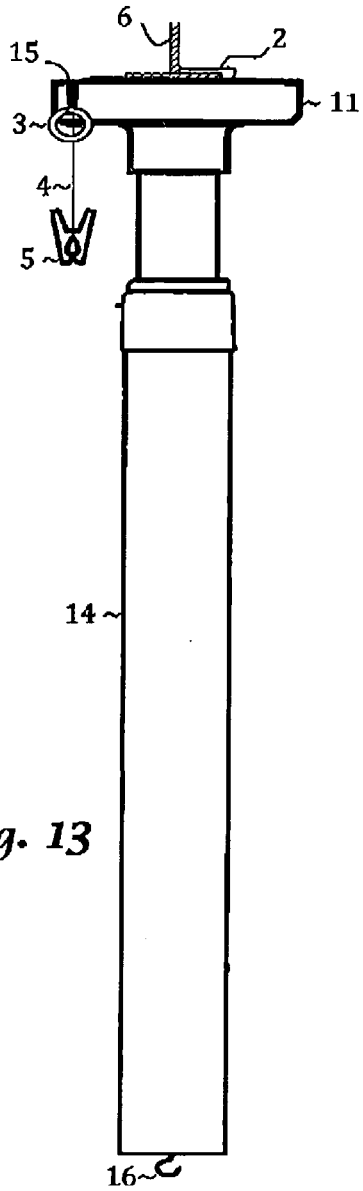
FIG. 13 illustrates an alternative embodiment of the cup and pole assembly with a telescoping installation pole.

FIG. 13 illustrates an alternative embodiment of the pole 14 and cup 11 assembly with a telescoping installation pole. The cup 11 is attached to the upper end of the pole 14, and the open hook 16 is affixed to the base of the pole 14. In this view the cup 11 is in position to assist in attaching the hanger 1 to the T-bar 6. When employing the pole 14 assembly, the user simply lifts the cup 11 containing the hanger 1 to the suspended ceiling, slides the hanger 1 onto the T-bar, and removes the pole 14. The pole 14 is then rotated on end, and the hook 16 is used to grasp the clip 5 and extend it to within reach. Also revealed in FIG. 13 is the cable slot 15 in the cup 11, which allows the cable 4, cable-stop 3, and clip 5 to be placed outside the cup 11 while installing the hanger 1 to the T-bar or wall rail.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. For example, although a nail and a screw may not be structural equivalents in that a nail employs a cylindrical surface to secure wooden parts together, whereas a screw employs a helical surface, in the environment of fastening wooden parts, a nail and a screw may be equivalent structures.

REFERENCES CITED

US Patent Documents

| | | |
|---|---|---|
| U.S. Pat. No. 4,112,550 | Sep. 12, 1978 | DeWitt, et al. |
| U.S. Pat. No. 4,135,692 | Jan. 23, 1979 | Ferguson |
| U.S. Pat. No. 4,556,184 | Dec. 3, 1985 | O'Sullivan |
| U.S. Pat. No. 5,052,733 | Oct. 1, 1991 | Cheung, et al. |
| US D321,639 | Nov. 19, 1991 | Adams |
| U.S. Pat. No. 5,247,725 | Sep. 28, 1993 | Vaughn, Jr. |
| U.S. Pat. No. 5,490,651 | Feb. 13, 1996 | Kump |
| U.S. Pat. No. 5,499,789 | Mar. 19, 1996 | Rose |
| U.S. Pat. No. 5,553,905 | Sep. 10, 1996 | Bentivegna |
| U.S. Pat. No. 5,632,519 | May 27, 1997 | Stock |
| U.S. Pat. No. 5,833,165 | Nov. 10, 1998 | Paugh |
| U.S. Pat. No. 5,870,845 | Feb. 16, 1999 | Ruderman, et al. |
| U.S. Pat. No. 6,036,153 | Mar. 14, 2000 | Rose, et al. |
| U.S. Pat. No. 6,073,875 | Jun. 13, 2000 | Paugh |
| U.S. Pat. No. 6,293,601 | Sep. 25, 2001 | Johnson |
| U.S. Pat. No. 6,634,610 | Oct. 21, 2003 | Ricci, et al. |
| US D497,086 | Oct. 12, 2004 | Lopes |
| U.S. Pat. No. 6,976,662 | Dec. 20, 2005 | Kump et al. |
| US D580,747 | Nov. 18, 2008 | Pollak, et al. |

The embodiments of the invention in which an exclusive property or privilege is claimed are defined as follows:

1. A hanging system comprising:

a pole;

a hanger that houses a spring-loaded reel and a retractable cable and the retractable cable having an inner end connected to the spring-loaded reel and an outer end extended outside of a hole in the hanger;

a cup, attached on one end of said pole, that holds said hanger, and the cup having a notch in the side configured for the retractable cable to extend through the notch and pass outside of the cup;

an adjustable cable stop and a clip that are juxtaposed and attached to the outer end of the retractable cable that is located outside of the hanger; and an open book, affixed to the surface of said pole and said cup assembly, that is used to grasp, lower, and raise said clip.

2. The hanging system of claim 1, wherein said hanger has a pressure clip on an exterior housing wall of the hanger and the pressure clip is adapted for attaching, removing, and repositioning the hanger to an inverted T-bar of a suspended ceiling.

3. The hanging system of claim 1, wherein said hanger has a pressure clip on an exterior housing wall of the hanger and the pressure clip is adapted for attaching, removing, and repositioning the hanger to a wall rail.

4. The hanging system of claim 1, wherein said hanger has a raised platform on an exterior housing wall of the hanger and the raised platform is adapted for attaching, removing, and repositioning the hanger to a ceiling surface.

5. The hanging system of claim 1, wherein said hanger has a raised platform on an exterior housing wall of the hanger and the raised platform is adapted for attaching, removing, and repositioning the hanger to an inverted T-bar of a suspended ceiling.

6. The hanging system of claim 1, wherein said open hook and said cup are affixed to opposite ends of the pole.

7. A hanging system comprising:

a pole;

a hanger that houses a spring-loaded reel and a retractable cable and said retractable cable having an inner end connected to said spring-loaded reel and an outer end extended outside of a hole in said hanger;

a pressure clip on an exterior housing wall of said hanger and said pressure clip is adapted for attaching, removing, and repositioning the hanger to an inverted T-bar of a suspended ceiling without using a ladder or any elevating device;

a cup, attached on one end of said pole, that holds said hanger, and the cup having a notch in the side configured for the retractable cable to extend through the notch and pass outside of the cup;

an adjustable cable stop and a clip that are juxtaposed and attached to said outer end of said retractable cable that is located outside of said hanger; and an open hook, affixed to the end of said pole and said cup assembly, that is used to grasp, lower, and raise said clip.

8. A hanging system comprising:

a pole;

a hanger that houses a spring-loaded reel and a retractable cable and said retractable cable having an inner end connected to said spring-loaded reel and an outer end extended outside of a hole in said hanger;

a pressure clip on an exterior housing wall of said hanger and said pressure clip is adapted for attaching, removing, and repositioning the hanger to a wall rail without using a ladder or any elevating device;

a cup, attached on one end of said pole, that holds said hanger, and the cup having a notch in the side configured for the retractable cable to extend through the notch and pass outside of the cup;

an adjustable cable stop and a clip that are juxtaposed and attached to said outer end of said retractable cable that is located outside of said hanger; and an open book, affixed to the end of said pole and said cup assembly, that is used to grasp, lower, and raise said clip.

9. A hanging system comprising:

a pole;

a hanger that houses a spring-loaded reel and a retractable cable and said retractable cable having an inner end connected to said spring-loaded reel and an outer end extended outside of a hole in said hanger;

a raised platform on an exterior housing wall of said hanger and said raised platform is adapted for attaching, removing, and repositioning the hanger to a ceiling surface without using a ladder or any elevating device;

a cup, attached on one end of said pole, that holds said hanger, and the cup having a notch in the side configured for the retractable cable to extend through the notch and pass outside of the cup;

an adjustable cable stop and a clip that are juxtaposed and attached to said outer end of said retractable cable that is located outside of said hanger;

and an open hook, affixed to the end of said pole and said cup assembly, that is used to grasp, lower, and raise said clip.

10. A hanging system comprising:

a pole;

a hanger that houses a spring-loaded reel and a retractable cable and said retractable cable having an inner end connected to said spring-loaded reel and an outer end extended outside of a hole in said hanger;

a raised platform on an exterior housing wall of said hanger and said raised platform is adapted for attaching, removing, and repositioning the hanger to an inverted T-bar of a suspended ceiling without using a ladder or any elevating device;

a cup, attached on one end of said pole, that holds said hanger, and the cup having a notch in the side configured for the retractable cable to extend through the notch and pass outside of the cup;

an adjustable cable stop and a clip that are juxtaposed and attached to said outer end of said retractable cable that is located outside of said hanger; and an open hook, affixed to the end of said pole and said cup assembly, that is used to grasp, lower, and raise said clip.

* * * * *